US005593321A

United States Patent [19]

Hotea

[11] Patent Number: 5,593,321

[45] Date of Patent: Jan. 14, 1997

[54] INTEGRAL SEAL AND STRAIN RELIEF MEMBER FOR A CONNECTOR

[75] Inventor: Gheorghe Hotea, Griesheim, Germany

[73] Assignee: The Whitaker Corporation, Wilmington, Del.

[21] Appl. No.: 432,308

[22] Filed: May 1, 1995

[30] Foreign Application Priority Data

May 3, 1994 [GB] United Kingdom ..... 9408755

[51] Int. Cl.[6] ..... H01R 13/40

[52] U.S. Cl. ..... 439/589; 439/460

[58] Field of Search ..... 439/587, 589, 439/274, 279, 275, 460, 461, 465, 470, 471, 598

[56] References Cited

U.S. PATENT DOCUMENTS

| | | | |
|---|---|---|---|
| 2,963,536 | 12/1960 | Kokalas | 439/461 |
| 4,241,967 | 12/1980 | Collins | 439/589 |
| 4,281,887 | 8/1981 | Luca | 439/589 |
| 4,629,269 | 12/1986 | Kailus | 439/587 |
| 4,639,061 | 1/1987 | Muzslay | 439/587 |
| 4,758,174 | 7/1988 | Michaels et al. | 439/589 |
| 4,946,402 | 8/1990 | Fink et al. | 439/274 |
| 4,973,266 | 11/1990 | Ballard | 439/589 |

FOREIGN PATENT DOCUMENTS

| | | |
|---|---|---|
| 2585888A1 | 7/1985 | France . |
| 2446252 | 9/1974 | Germany . |
| 3607451A1 | 3/1986 | Germany . |

*Primary Examiner*—Neil Abrams
*Assistant Examiner*—Barry Matthew L. Standig

[57] ABSTRACT

A seal and strain relief member comprises a plastic injection moulded strain relief member and an elastomeric seal over-moulded to the strain relief member thereby forming an integral part. The strain relief member comprises clamping halves pivotally attached by hinges to a base section having wire receiving cavities therethrough, the base section extending into seal support walls. The clamping halves can be pivoted towards each other to clamp conducting wires therebetween and thereby provide a strain relief means. The strain relief member support walls purport not only to provide a bonding surface for the seal thereto, but in particular provides support to the seal with respect to axial and radial compression thereby preventing excessive or uneven deformation of the seal to ensure reliable and effective sealing. The strain relief member can be integrally moulded to a carrier strip for connection to other strain relief members thereby reducing handling and assembly costs, in particular of the seal members.

18 Claims, 3 Drawing Sheets

2
22
24

22
26
24
8
10
18
20

8
10
38
36
3
54
2
4
40
6
32
34

26
8
28
30
18
20
22
16
14
28
12

2
5
5
4
4

2
26
24
6
44
2
40

INTEGRAL SEAL AND STRAIN RELIEF MEMBER FOR A CONNECTOR

BACKGROUND OF THE INVENTION

1. Field of the Invention

This invention relates to an integral seal and strain relief member for a connector.

2. Description of the Prior Art

Connectors subject to harsh environmental conditions are commonly provided with an elastomeric sealing member having cavities for tightly receiving conducting wires therethrough, and an outer sealing surface having sealing ribs extending therearound that are tightly compressed against a complementary housing cavity thus providing sealing between the wire receiving area and the mating area of the connector. It is also known to provide supplementary strain relief means that securely hold the plurality of conducting wires to the connector housing in addition to the retention means of the terminals.

One of the problems when providing a seal having a plurality of single wire sealing cavities arises from the lack of rigidity which may cause uneven deformation of the seal; therefore either reducing the effectiveness of the seal, or requiring the seal to be made in a plurality of parts having fewer wire receiving cavities and separated by wall sections of the housing.

Furthermore, for cost reasons it would be advantageous to reduce the number of parts to be manufactured, handled and assembled, Additionally, it would be advantageous to provide the parts to be assembled in a manner adapted for cost-effective automated handling and assembly.

SUMMARY OF THE INVENTION

It is therefore an object of this invention to provide a connector seal member that is integrally moulded to a wire strain relief member.

It is a further object of this invention to provide an integral seal member for sealing a plurality of conducting wires, that is reliable and cost-effective.

It is a further object of this invention to provide a connector having a cost-effective and reliable integral seal and strain relief member.

The objects of this invention have been achieved by providing a seal member comprising an elastomeric injection moulded seal integral with an injection moulded strain relief member for clamping to one or more conducting wires when fully assembled to a connector housing therefor. The strain relief member can comprise wall support members projecting into the elastomeric sealing portion for providing structural support to the sealing portion. The strain relief member could also comprise a pair of opposed pivotable clamps that are rotatable towards each other when the strain relief member is inserted into the connector housing, so as to clamp conducting wires therebetween.

BRIEF DESCRIPTION OF THE DRAWINGS

FIG. 3 is a view in the direction of arrow 3 of FIG. 2;

DETAILED DESCRIPTION OF THE PREFERRED EMBODIMENT

Figures 1, 2, 4, 5, 6, 7:
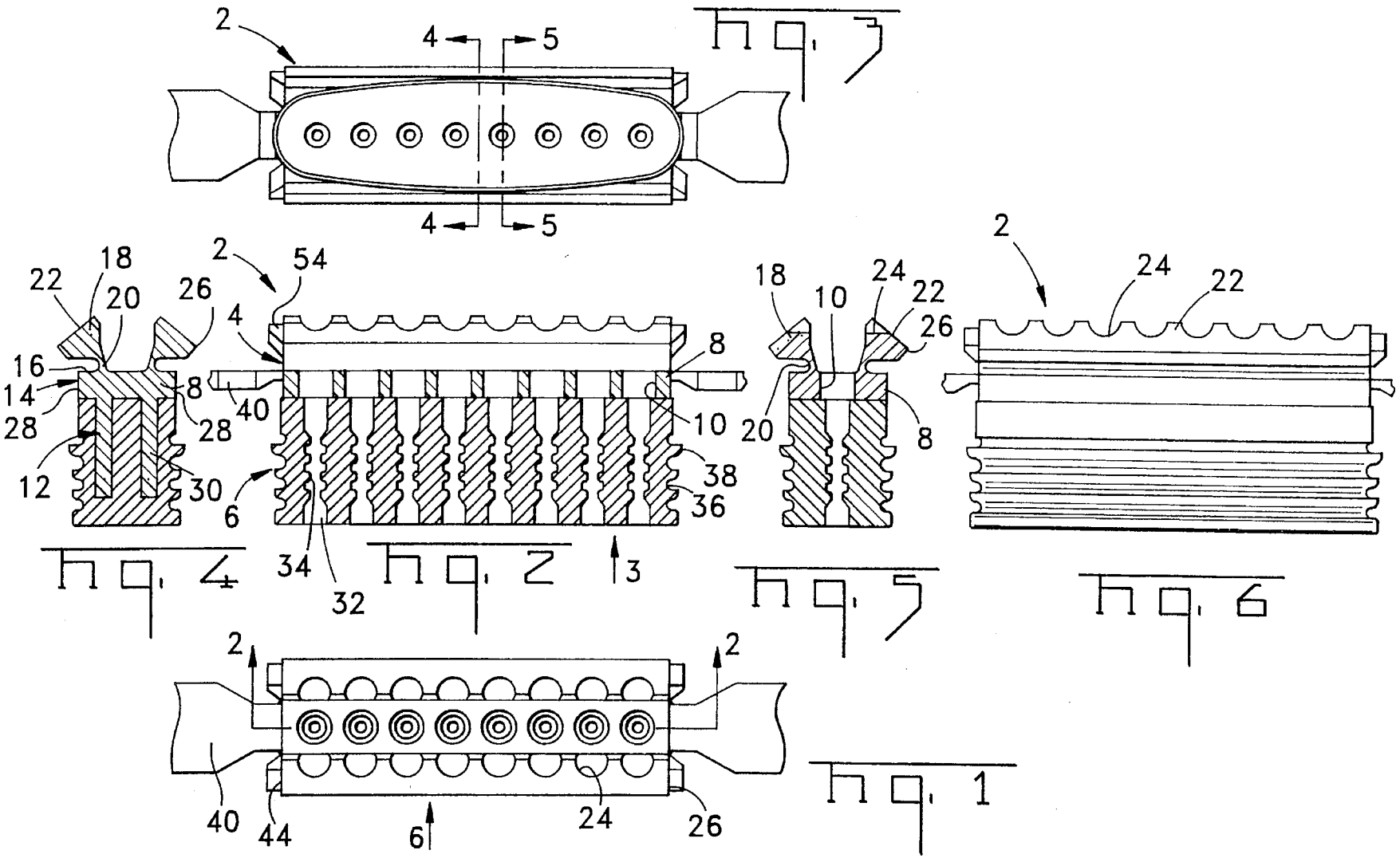
FIG. 1 is a view of a wire receiving end of an integral strain relief and seal member, still attached to a carrier strip of a continuous injection moulding process.
FIG. 2 is a cross-sectional view through lines 2—2 of FIG. 1.
FIG. 4 is a cross-sectional view through lines 4—4 of FIG. 3.
FIG. 5 is a cross-sectional view through lines 5—5 of FIG. 3.
FIG. 6 is a view in the direction of arrow 6 of FIG. 1.
FIG. 7 is a partial view of a connector assembly receiving a plurality of the integral seal and strain relief members.
Figure 7:
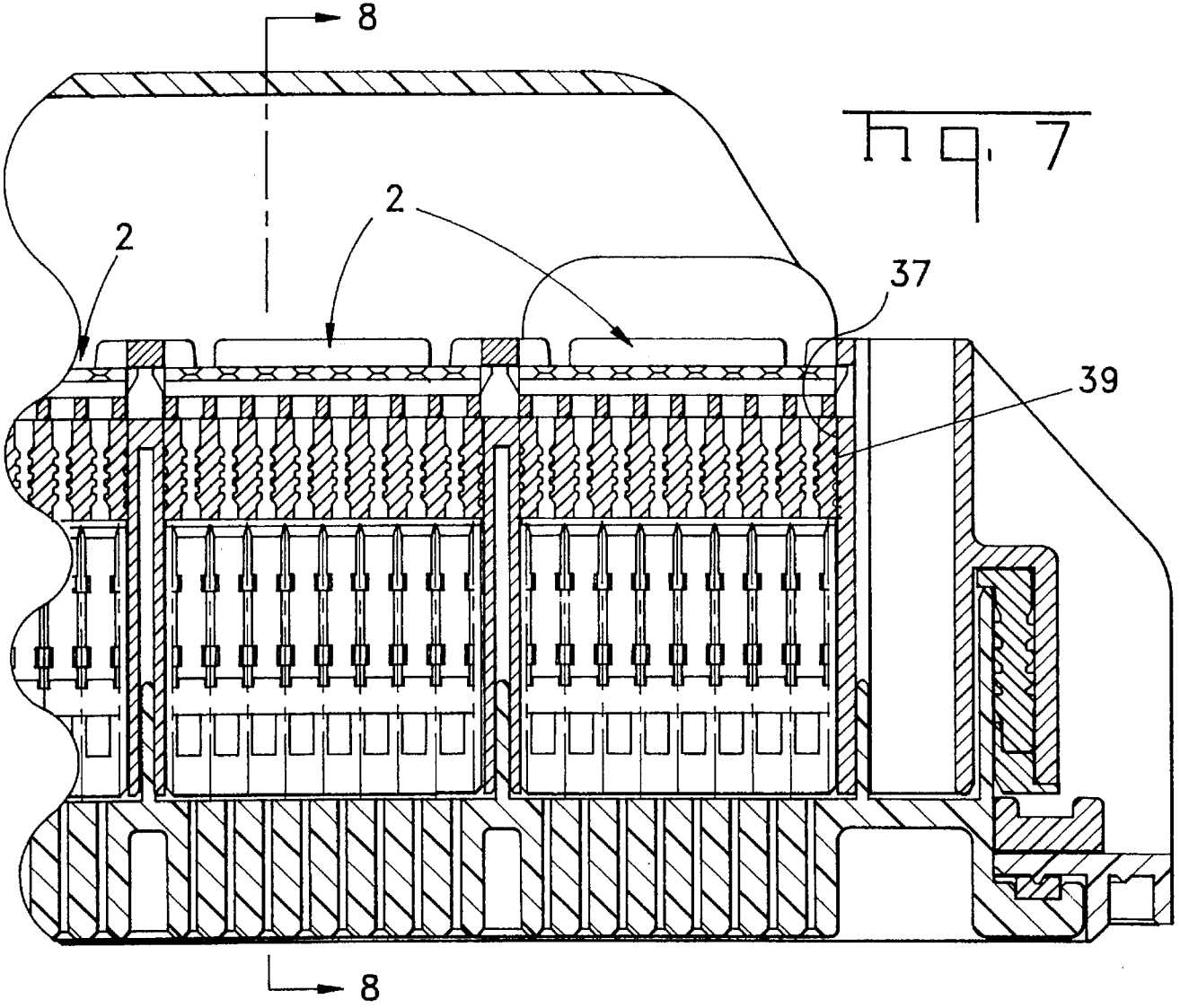

Referring to FIGS. 1–6, a seal and strain relief member generally shown at 2 comprises a plastic injection moulded strain relief member 4 and an injection moulded elastomeric seal 6 overmoulded to the strain relief member 4. The strain relief member 4 comprises a base wall 8 having a plurality of cavities 10 for receiving conducting wires therethrough (not shown), a seal support section 12 extending from the base section 8 into the seal 6, and a strain relief section 14 extending from an outer face 16 of the base section 8. The strain relief section 14 comprises a pair of opposed clamping halves 18 that are pivotally attached to the base section 8 by flexible integral hinges 20. The clamping halves 18 comprise clamping surfaces 22 having arcuate grooves 24 cut obliquely thereinto, the grooves aligned with the wire receiving cavities 10. In a disconnected position, the clamping halves 18 are directed away from each other and have outer portions 26 that project beyond sides 28 of the base section 8.

The seal support section 12 comprises a pair of support walls 30 that extend in the direction of the wire receiving cavities 10 and are spaced apart so as to flank the holes 10 for allowing passage of conducting wires therebetween.

Figure 8:
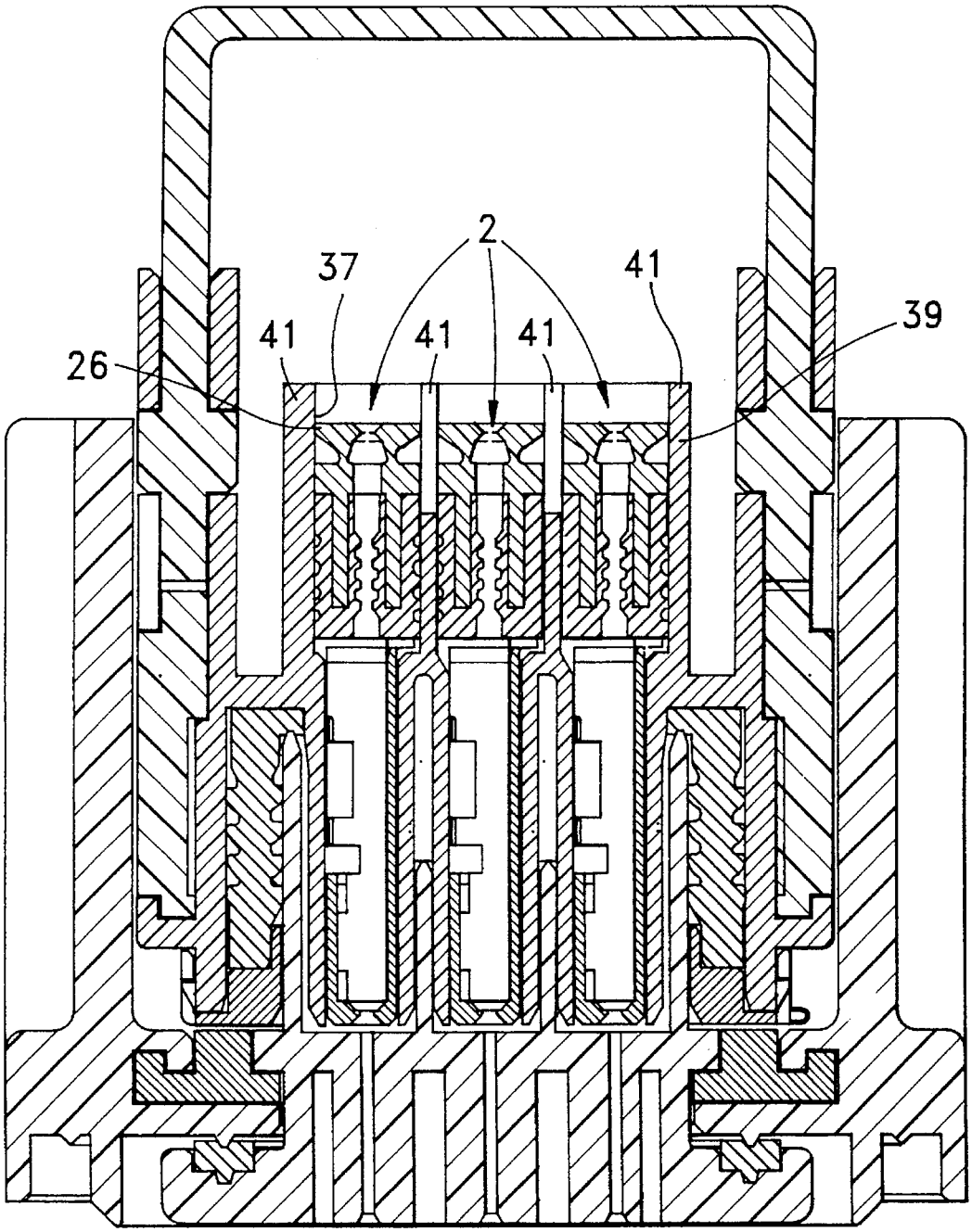
FIG. 8 is a cross-sectional view through lines 8—8 of FIG. 7.

The elastomeric seal 6 comprises a plurality of wire receiving cavities aligned with the cavities 10 of the strain relief member 14, the cavities 32 comprising sealing ribs 34 therein for compression against the conducting wires to provide good sealing therebetween. An outer sealing surface 36 of the seal 6 also comprises sealing ribs 38 around the periphery, the outer sealing surface 36 cooperable with the cavity surface 37 of a connector assembly housing 39 for receiving the seal for sealing therebetween (see FIGS. 7–8).

The seal and strain relief member 2 can be manufactured in a continuous process by injection moulding the strain relief member 4 integrally with a carrier strip 40, then moulding over the seal support section 12 of the strain relief member 4. The elastomeric seal 6 is thus bonded to the strain relief member which thereby forms an integral part, the seal and strain relief member 2 being moveable from the strain relief member injection-mould station to the seal moulding station (although it could also be imagined to effectuate both of these processes without moving the member 2 but rather the moulding dies). The strain relief member 4 is interconnected to the following seal and strain relief member 2 via carrier strips 40 that are moulded to the strain relief members 4 in a continuous moulding process. This therefore provides a means for cost-effective handling, transport and assembly of the seal and strain relief member 2 to corresponding connector housings 39, the latter process being done at a different location. Provision of the seal and strain relief members 2 on a carrier strip enables assembly thereof to the connector housing 39 and conducting wires with rapid automated assembly machines. In particular, the difficult and expensive process of sorting and assembling separate seals is eliminated.

Assembly of the seal and strain relief member 2 to a connector assembly housing 39 will now be described. Firstly, the seal and strain relief member 2 is preassembled to the connector housing 39 by partially inserting the seal and strain relief member into a corresponding receiving cavity 37 of the housing 39. Conducting wires terminated to terminals (or possibly not yet terminated) can then be inserted through the wire yet terminated) can then be inserted through the wire receiving cavities 10 and 32 of the strain relief and seal member 2. The seal and strain relief member 2 is the fully inserted into the connector housing such that wall portions 41 of the connector housing 39 engage with the outwardly protruding portions 26 of the strain relief clamping halves 18 causing them to pivot about the flexible hinges 20 and clamp onto the conducting wires whereby the arcuate portions 24 are biased against the wires. Alternatively, the strain relief clamping halves 18 could be provided with latching means 54, at ends 56 thereof that can be clamped to the wires prior to insertion of the seal and strain relief member 2 fully into a connector housing. A further assembly alternative, is to completely assemble the seal and strain relief member 2 to a connector housing, then insert the wires through the cavities 10, 32 and then clamp the wires by pivoting together the strain relief clamping halves 18 until the latching means 54 engage together.

Due to the support walls 30 of the strain relief member 4 extending into the elastomeric seal 6, support is given to the supple seal 6 in both a axial direction parallel to the cavities 32, and with respect to a compression force perpendicular thereto on the outer sealing surface 36 when the seal is positioned in the housing cavity. The latter thus prevents excessive or uneven deformation of the seal which would reduce it's sealing effectiveness and reliability.

Advantageously therefore, the integral seal and strain relief member provides a compact and cost-effective manner of combining sealing and strain relief functions of a connector, and additionally providing a seal support means to prevent excessive or uneven deformation of the seal and therefore providing an effective and reliable multi-wire single seal. A further advantage of combining the seal and strain relief member in an integral part is the provision of a carrier strip 40 for interconnecting the members on a continuous strip thereby reducing handling and assembly costs of the strain relief and seal member to a connector. The latter is particularly advantageous when considering the difficulty of sorting loose seals, or if the seals are provided on a separate carrier strip especially made therefor there is a great reduction in manufacturing and handling costs.

I claim:

1. A seal and strain relief assembly comprising a molded elastomeric seal for sealing between one or more conductors and a connector housing, the seal comprising one or more conductor receiving cavities extending therethrough for sealing around the conductors, and an outer sealing surface for sealing against the housing, the assembly further comprising a molded strain relief member of more rigid material than the seal, having a strain relief section for securely gripping the one or more conductors, the assembly characterized in that the strain relief member and said seal are molded together as an integral part and that the strain relief member comprises at least one support wall extending into the seal in substantially the same direction as the conductor receiving cavities.

2. The assembly of claim 1 characterized in that there are a pair of support walls flanking a row of one or more conductor receiving cavities.

3. The assembly of claim 1 characterized in that the support wall extends from one end of the seal to a position proximate the opposing end of the seal.

4. The assembly of claim 1 characterized in that the strain relief member comprises a base section having one or more cavities extending therethrough aligned with the conductor receiving cavities of the seal, the strain relief section extending from one side of the base section and the support wall extending from the other side thereof, the other side of the base section being contiguous the seal.

5. The assembly of claim 1 characterized in that the strain relief section comprises a pair of clamping halves pivotly attached to a base section of the strain relief section via a flexible integral hinge, the clamping halves having opposed clamping surfaces for clamping the one or more conductors therebetween.

6. The assembly of claim 5 characterized in that corners of the clamping halves protrude beyond side surfaces of the strain relief section prior to clamping of the conductors, the corners engageable against walls of the connector when protruding beyond the side surfaces.

7. The assembly of claim 5 characterized in that the clamping halves are provided with latching means for securely holding the clamping halves together for clamping the one or more conductors therebetween.

8. The assembly of claim 1 characterized in that a plurality of the strain relief members are attached together forming a long band for easy handling and automated assembly thereof into the connector assemblies.

9. The assembly of claim 8 characterized in that the strain relief members are attached together via an integral join section, the strain relief and seal assembly thus being formed in a continuous moulding process.

10. A sealed connector comprising a housing having one or more seal receiving cavities bounded by walls, a seal mounted in the seal receiving cavities for sealing between one or more conductors and the connector housing, and a strain relief member having a strain relief section for securely gripping the one or more conductors, characterized in that the strain relief member and seal are molded together as an integral part and that the strain relief section comprises a pair of clamping halves pivotably attached to a base section of the strain relief section via a flexible integral hinge, the clamping halves having opposed clamping surfaces for clamping the one or more conductors therebetween.

11. The connector of claim 10 characterized in that corners of the clamping halves protrude beyond side surfaces of the strain relief section prior to clamping of the conductors, the corners engageable against walls of the connector when protruding beyond the side surfaces.

12. The connector of claim 10 characterized in that the strain relief section comprises at least one support wall extending into the seal in substantially the same direction as the conductor receiving cavities.

13. The connector of claim 12 characterized in that the strain relief member comprises a base section having one or more cavities extending therethrough aligned with the conductor receiving cavities of the seal, the strain relief section extending from one side of the base section and the support wall extending from the other side thereof, the other side of the base section being contiguous the seal.

14. A seal and strain relief assembly comprising a molded elastomeric seal for sealing between one or more conductors and a connector housing, the seal comprising one or more conductor receiving cavities extending therethrough for sealing around the conductors, and an outer sealing surface for sealing against the housing, the assembly further comprising a molded strain relief member of more rigid material than the seal, having a strain relief section for securely gripping the one or more conductors, the assembly characterized in that the strain relief member and said seal are molded together as an integral part and that the strain relief section comprises a pair of clamping halves pivotably attached to a base section of the stain relief section via a flexible integral hinge, the clamping halves having opposed clamping surfaces for clamping the one or more conductors therebetween.

15. The assembly of claim 14 characterized in that corners of the clamping halves protrude beyond side surfaces of the strain relief section prior to clamping of the conductors, the corners engageable against walls of the connector when protruding beyond the side surfaces.

16. The assembly of claim 14 characterized in that the clamping halves are provided with latching means for securely holding the clamping halves together for clamping the one or more conductors therebetween.

17. A sealed connector comprising a housing having one or more seal receiving cavities bounded by walls, a seal mounted in the seal receiving cavities for sealing between one or more conductors and the connector housing, and a strain relief member having a strain relief section for securely gripping the one or more conductors, characterized in that the strain relief member and seal are molded together as an integral part and that the strain relief section comprises at least one support wall extending into the seal in substantially the same direction as the conductor receiving cavities.

18. The connector of claim 17 characterized in that the strain relief member comprises a base section having one or more cavities extending therethrough aligned with the conductor receiving cavities of the seal, the strain relief section extending from one side of the base section and the support wall extending from the other side thereof, the other side of the base section being contiguous the with seal.

* * * * *